US005405006A

United States Patent [19]

Burgdorf et al.

[11] Patent Number: 5,405,006

[45] Date of Patent: Apr. 11, 1995

[54] PALLET CONTAINER

[75] Inventors: Märten Burgdorf, Swistal; Hans Ritter, Kön, both of Germany

[73] Assignee: Mauser-Werke GmbH, Bruehl, Germany

[21] Appl. No.: 193,092

[22] PCT Filed: Oct. 28, 1993

[86] PCT No.: PCT/EP93/02994

§ 371 Date: Feb. 7, 1994

§ 102(e) Date: Feb. 7, 1994

[87] PCT Pub. No.: WO94/10050

PCT Pub. Date: May 11, 1994

[30] Foreign Application Priority Data

Oct. 29, 1992 [DE] Germany ..... 92 14 708. U

[51] Int. Cl.[6] ..... B65D 19/00

[52] U.S. Cl. ..... 206/386; 220/485; 220/683

[58] Field of Search ..... 206/386; 220/410, 485, 220/495, 683, 684

[56] References Cited

U.S. PATENT DOCUMENTS

| | | | |
|---|---|---|---|
| 837,383 | 12/1906 | Carlton | 220/485 |
| 1,439,169 | 12/1922 | Kahan | 220/683 |
| 3,191,723 | 6/1965 | Shoup | 220/495 |
| 3,225,952 | 12/1965 | Stiles | 220/684 |
| 3,688,937 | 9/1972 | Ellison | 220/495 |
| 4,281,813 | 8/1981 | Garrity | 220/485 |
| 4,947,988 | 8/1990 | Schutz | 220/485 |

FOREIGN PATENT DOCUMENTS

| | | | |
|---|---|---|---|
| 1493359 | 11/1977 | United Kingdom | 220/485 |
| 9118806 | 12/1991 | WIPO | 206/386 |

*Primary Examiner*—David T. Fidei
*Attorney, Agent, or Firm*—Pennie & Edmonds

[57] ABSTRACT

A pallet container is disclosed as including a thin-walled container supported on a floor pallet and tightly surrounded by a wire grid connected to the floor pallet. The wire grid includes vertical edges which are joined together along a vertical junction region by a sheet-metal strip which is bent about the wire of the surrounding wire grid.

8 Claims, 3 Drawing Sheets

FIG.3
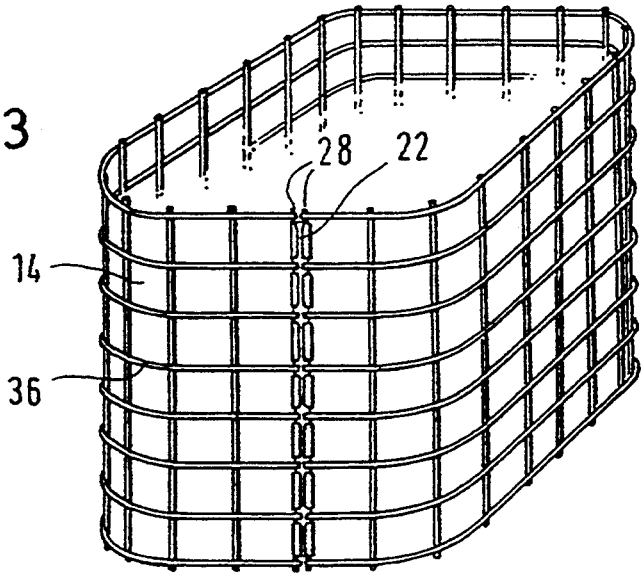
FIG.5
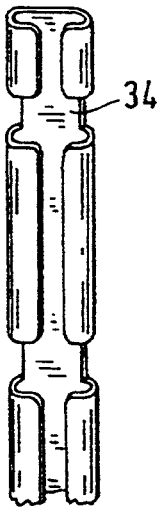
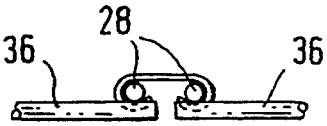
FIG.4a
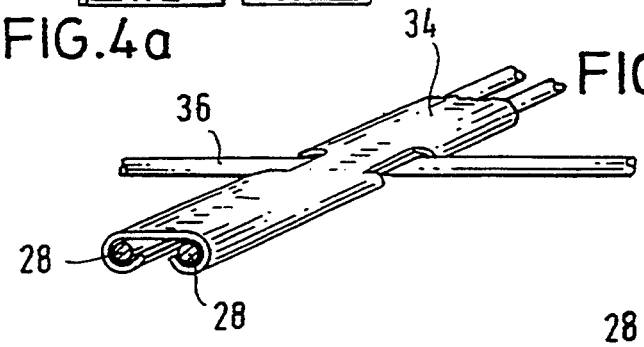
FIG.4b
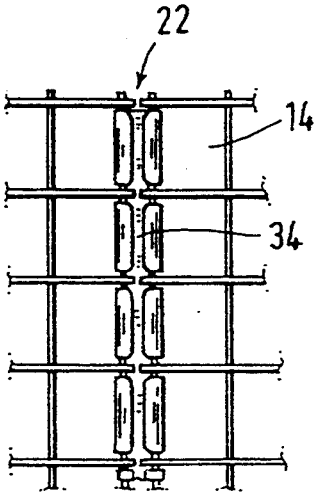
FIG.6
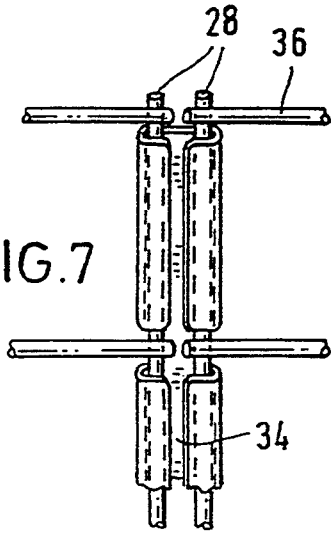
FIG.7

PALLET CONTAINER

BACKGROUND OF THE INVENTION

The invention relates to a pallet container with a thin-walled plastic container for liquid or flowable fill substances, with a wire grid or a tubular grid consisting of horizontal and vertical grid rods (tubular rods), which tightly surround the plastic container in the manner of a support casing, and with a floor pallet on which the plastic container rests and to which the wire grid support casing is solidly connected, the wire-grid support casing consisting of one or two half-length grid plates, whose corner regions are bent at a right angle and which are solidly joined to one another in one or respectively two vertical junction regions.

Such a pallet container with a wire-grid support casing for the inner thin-walled plastic container is known from the DE-B 30 39 635. The wire-grid support casing is fastened on the floor pallet—a conventional flat pallet made of wood—by means of clasps, clamps, or claws which grip over the lowermost horizontally circumferential rod of the grid. The clasps or claws can be nailed (pinned) into the surface of the wooden pallet or they can be screwed onto the top plate of the pallet.

Pallet containers for industrial use must pass an official model inspection for approval, during which they must meet certain quality criteria. For example, interior pressure tests and fall tests are performed with filled pallet containers from specified fall heights. A special test is a ground fall flat on the floor pallet.

During such a fall test, it has appeared that, when striking the ground, the interior container tries to expand radially in all planar directions due to the kinetic energy and the impulse-like surge pressure. It often happens here that a sheath clinching of the horizontal grid rods of the support casing or the spot-welds of the vertical grid rods tear open. The fastening of the grid rods in the junction region of the support casing thus represents an important weak point. Since the wire-grid support casing is fixed in the junction region only at a few points, the wire grid is deformed and twisted very unevenly when the pallet container topples; the welding points of the wire grid sometimes tear apart, and the free ends of wire rods can damage the thin-walled plastic container.

SUMMARY OF THE INVENTION

It is an object of the present invention to eliminate these disadvantages and to specify a pallet container which provides, with simple means, better fixation of the grid plate in the vertically directed junction region, such that the wire-grid support casing will deform more uniformly and to a lesser extent when falling from greater heights, without the junction region tearing open and the interior of the container being at risk for damage or untightness.

By using a sheet-metal strip or a sheet-metal plate which covers several grid rods and whose outer edges have a simple bend (flange) or by slotting formed sheet-metal tabs (brackets) about vertical grid rods running respectively to the right and left parallel to the junction region of the grid plate of the grid support casing, on the one hand it becomes possible, by a simple production engineering process, to join/fix the wire grid physically and securely in the junction region and, on the other hand, this mutual fixation of the grid plate edges over a wide area represents a very flexible region which is also plastically deformable under over-stress, especially when the pallet container falls on the ground, such that extreme stresses of this kind will be withstood perfectly and a tearing apart of the grid casing as well as a lack of tightness in the plastic container will be prevented.

A special development of the invention provides that the sheet-metal strip be designed as a wider sheet-metal plate which covers at least two vertical grid rods on each side of the junction region and which grips and encompasses these covered grid rods with its respective outer edge and with the inner sheet-metal tabs that are punched out on three sides. The bent sheet-metal strips at the slotted outer edges and the inner sheet-metal tabs of the sheet-metal closure plate should be between 20 and 90 mm long, preferably about 40 to 60 mm long.

Another development of the invention can provide that the sheet-metal plate is wider and covers more vertical grid rods in its lower region than in its upper region. Thus, for example, it is sufficient if two vertical grid rods are covered in the upper half of the sheet-metal plate and if the sheet-metal plate becomes wider by stages further down so that three grid rods are covered and then all the way down at least four grid rods are covered, and are solidly fixed by the bent outer edges and the inner sheet-metal tabs.

BRIEF DESCRIPTION OF THE DRAWINGS

The invention is explained and described in more detail below, in terms of the embodiments that are shown in the drawings.

FIG. 3 schematically shows the grid casing with its junction region.

FIGS. 4 through 7 show further detail views of another design for connecting the grid casing.

FIG. 8 is a detailed view similar to FIG. 6 showing still another design for connecting the grid casing.

FIG. 1 shows a pallet container 10 with an inner, thin-walled plastic container 12 for liquid or flowable fill materials, with a wire grid casing 14, which tightly surrounds the plastic container 12 in the manner of a support casing, and which consists of horizontal and vertical wire rods 28, 36, and with a floor pallet 16. The wire-grid support casing 14 is solidly but detachably connected to the floor pallet 16.

Figure 1:
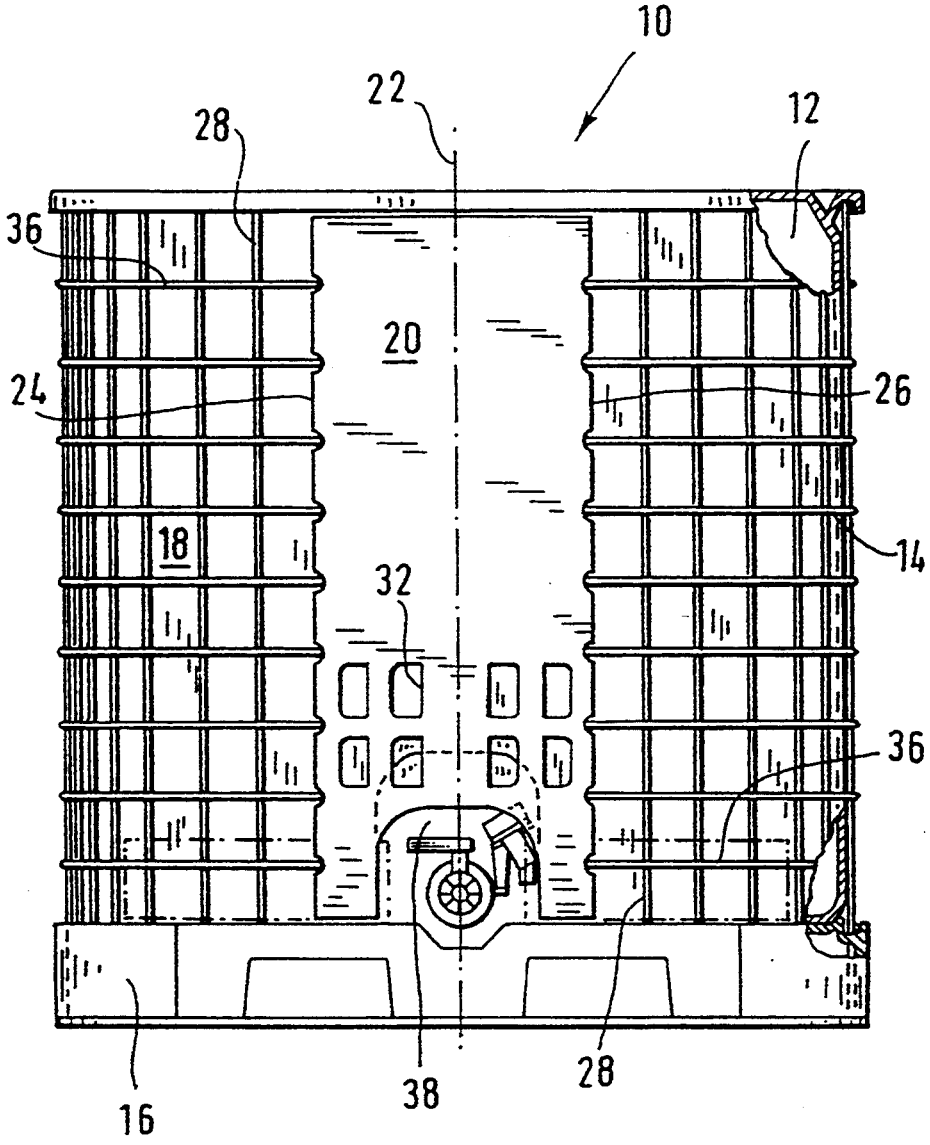
FIG. 1 shows an inventive pallet container with a novel connection of the wire-grid support casing.

The wire-grid support casing 14 here consists of an integral grid plate 18, which is bent at a right angle in each of its four corner areas. The vertical junction region 22 of the support casing 14 and of the grid plate 18 preferably is situated centered above the floor-side valve cock of the plastic container 12. The junction region 22 is covered by a sheet-metal plate 20. At its left outer edge 24 and at its right outer edge 26, the latter is bent around a vertical grid rod 28. So that the valve cock will remain accessible, an appropriate recess 38 is situated below in the sheet-metal plate 20. In the example shown here, the sheet-metal plate 20 covers three vertical grid rods on each side of the junction region 22. The interior grid rods are always clinched with three-sided punched sheet-metal tabs 32.

Figure 2:
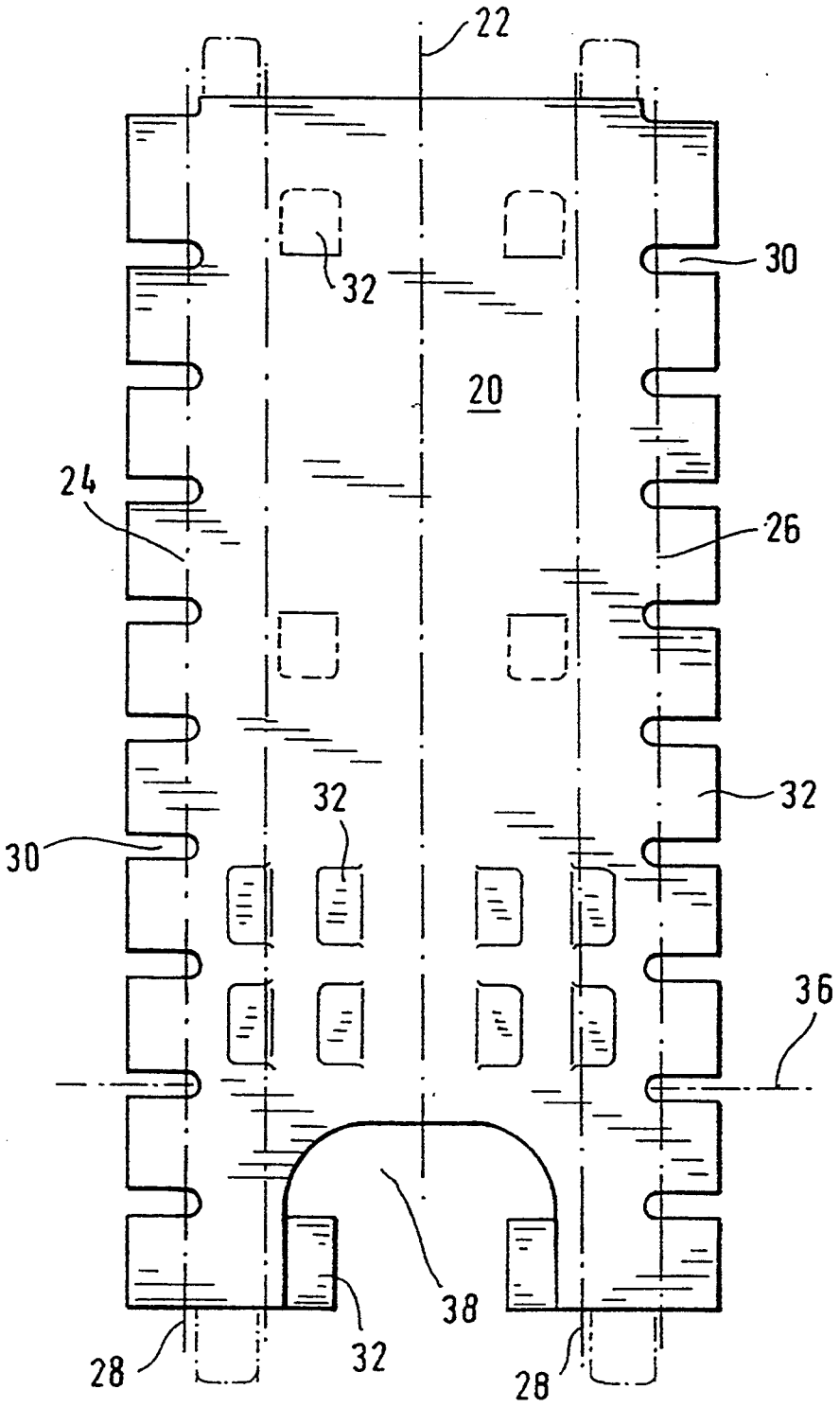
FIG. 2 shows a wider sheet-metal strip to connect the grid casing.

FIG. 2 shows, in a magnified representation, the sheet-metal plate 20 for clinching the grid mat. For a usual 1000 l pallet container, the sheet-metal plate 20 has approximately the following dimensions: height about 1120 mm, width about 520 mm. The sheetmetal plate 20 consists of stainless or galvanized steel sheet with a thickness of e.g. 1.2 mm or 1.5 mm.

The reference number 28 indicates the vertical grid rods, which are shown by dashes. The brackets/tabs of the lateral outer edge are bent around these vertical grid rods. At the level of the horizontal grid rod 36, the sheet-metal plate 20 has a slot 30 or a recess at its outer edge, so that the sheet-metal tabs can be bent flat and smooth about the vertical grid rods. As is shown by dashes, several similar sheet-metal tabs can also be situated at the upper edge and/or lower edge, as well as inside the sheet-metal plate. These also are clinched together with horizontal grid rods.

A note or label plate for identifying the fill material can suitably be affixed on the flat sheet-metal plate 20.

FIG. 3 once again shows in perspective a grid plate 18, bent (at a right angle) four-fold with respect to the actual support casing 14, and having vertical and horizontal grid rods 28, 36. In front, the grid plate closes in the junction region 22.

FIG. 4*a* shows a top view of the junction region and FIG. 4*b* shows a perspective view of two neighboring vertical grid rods 28, which are clinched together by means of a narrow sheetmetal strip 34 which covers the junction region 22. FIG. 5 shows the sheet-metal strip 34 with its bent outer edges and the corresponding recesses (slots) for the horizontal grid rods. FIG. 6 schematically sketches an inside view of the junction region 22 and of the clinched sheet-metal strips 34. FIG. 7 shows a magnified and clearer view of the way the outer edges of the sheet-metal strip 34 are clinched about the vertical grid rods 28 so as to make a smooth contact. Without doubt, the wire grid plate could also be connected to several narrow, horizontal, sheet-metal strips, whose outer edges would then be clinched with the adjoining, horizontal grid rods—e.g. also in alternation in the individual folds. FIG. 8 shows this type of construction wherein several horizontal sheet-metal strips 42 are provided, disposed one above the other. As shown in FIG. 8, the side edges are bent around neighboring horizontal grid rods (36) and the two lateral outer edges (24, 26) are bent around a vertical grid rod (28) which runs parallel to the junction region (22) of the grid plate (18).

An essential feature of this type of mutual fixation of the gridplate edges is that the outer edges 24, 26 of the sheet-metal tabs/brackets 32 of the galvanized steel sheet-metal plate 20 are bent/flanged about vertical grid rods 28 and/or also horizontal grid rods 36 to the right and left next to the junction region 22 of the grid casing 14. The floor pallet 16 of the pallet container 10 can consist optionally of wood, metal tubing, or metal frame parts or the like, or preferably of recyclate plastic.

The connection of the grid casing 14 by means of the clinch sheetmetal plate 20 is therefore characterized by high flexibility and a favorable elastic and plastic deformation behavior, especially when the pallet container falls to the ground. All ground fall tests with filled pallet containers from heights of 1.6 m to 2.2 m have had positive results.

List of Reference Symbols

10 pallet container
12 plastic container
14 wire-grid support casing
16 floor plate
18 grid plate
20 sheet-metal strip/plate
22 junction region
24 left outer edge (20)
26 right outer edge (20)
28 vertical grid rod
30 slot/recess (20)
32 sheet-metal tabs (20)
34 narrow sheet-metal strip
36 horizontal grid rod
38 recess for the valve cock (20)

We claim:

1. In a pallet container (10) with a thin-walled plastic container (12) for liquid or flowable fill substances, with a grid consisting of vertical and horizontal grid rods (28, 36), which tightly surround the plastic container (12) to define a wire-grid support casing (14) having a top and a bottom, and with a floor pallet (16) on which the plastic container (12) rests and to which the bottom of the wire grid support casing (14) is solidly connected, the wire-grid support casing (14) consisting of at least one grid plate (18), with corner regions bent at an angle and joined to one another in at least one vertical junction region (22) extending substantially from the top to the bottom of the support casing (141, the improvement wherein:

each grid plate (18) is joined by a single sheet-metal strip (20) which covers each of said junction regions (22) from the top to the bottom of the support casing (14), said sheet-metal strip including lateral outer edges (24, 26) bent, between each of said horizontal grid rods (36), about at least one vertical grid rod (28) to either side of said junction region (22).

2. The pallet container of claim 1, wherein said vertical sheet-metal strip (20) is vertically oriented with respect to said junction (22) and includes lateral slots (30) defining outer sheet-metal tabs (32) therebetween, said slots (30) extending laterally inwardly from the outer edge (24, 26) of said sheet-metal strip (20) for receiving the horizontal grid rods (36), said outer edges (24, 26) being bent, with said tabs (32) one above the other and at several points between the horizontal grid rods (36), about at least one vertical grid rod (28) to either side of said junction region (22).

3. The pallet container of claim 1, wherein the sheet-metal strip (20) is wide enough to each side of the junction region (22) of the wire grid plate (18) to cover at least two vertical grid rods (28), and its outer edges (24, 26) are bent about the covered grid rods (28) furthest from said junction region (22).

4. The pallet container of claim 3, wherein several inner sheet-metal tabs (32) are integrally formed in the sheet-metal strip (20) inwardly of said outer edges (24, 26), and these sheet-metal tabs (32) are bent around other covered grid rods (28, 36).

5. In a pallet container (10) with a thin-walled plastic container (12) for liquid or flowable fill substances, with a grid consisting of vertical and horizontal grid rods (28, 36), which tightly surround the plastic container (12) to define a wire-grid support casing (14), and with a floor pallet (16) on which the plastic container (12) rests and to which the wire grid support casing (14) is solidly connected, the wire-grid support casing (14) consisting of at least one grid plate (18), with corner regions bent at an angle and joined to one another in at least one vertical junction region (22), the improvement wherein:

each grid plate (18) is joined by a plurality of horizontally extending sheet-metal strips (20) disposed one above the other and which covers said junction region (22), each of said sheet-metal strips including upper and lower edges bent around neighboring horizontal grid rods (36) and two lateral outer edges (24, 26) each of which is bent around a vertical grid rod (28) which is located to either side of said junction region (22) and which runs parallel to the junction region (22) of the grid plate (18).

6. The pallet container of any one of the preceding claims 2 through 5, wherein the depth of the slots (30) in the outer edges (24, 26) of the sheet-metal strip (20) define the length of the sheet-metal tabs (32) and measure between 20 mm and 90 mm.

7. The pallet container of any one of claims 1 through 4 and 8, wherein a lower section of the sheet-metal strip (20) is wider and covers more vertical grid rods (20) than an upper section.

8. In a pallet container (10) with a thin-walled plastic container (12) for liquid or flowable fill substances, with a grid consisting of vertical and horizontal grid rods (28, 36), which tightly surround the plastic container (12) to define a wire-grid support casing (14), and with a floor pallet (16) on which the plastic container (12) rests and to which the wire grid support casing (14) is solidly connected, the wire-grid support casing (14) consisting of at least one grid plate (18), with corner regions bent at an angle and joined to one another in at least one vertical junction region (22), the improvement wherein:

each grid plate (18) is joined by at least one sheet-metal strip (20) which covers said junction region (22), said sheet-metal strip including lateral outer edges (24, 26) bent about at least one vertical grid rod (28) to either side of said junction region (22), said sheet-metal strip (20) being wide enough to each side of the junction region (22) of the wire grid plate (18) to cover at least two vertical grid rods (28), and its outer edges (24, 26) are bent about the covered grid rods (28) furthest from said junction region (22); and wherein several inner sheet-metal tabs (32) are integrally formed in the sheet-metal strip (20) inwardly of said outer edges (24, 26), and these sheet-metal tabs (32) are bent around the other covered vertical grid rods (28).

* * * * *